United States Patent [19]

Comolli et al.

[11] Patent Number: 4,495,055

[45] Date of Patent: Jan. 22, 1985

[54] COAL CATALYTIC HYDROGENATION PROCESS USING DIRECT COAL SLURRY FEED TO REACTOR WITH CONTROLLED MIXING CONDITIONS

[75] Inventors: Alfred G. Comolli, Yardley; Edwin J. Hippo, Morrisville, both of Pa.

[73] Assignee: Hri, Inc., Gibbsboro, N.J.

[21] Appl. No.: 574,223

[22] Filed: Jan. 26, 1984

Related U.S. Application Data

[63] Continuation-in-part of Ser. No. 365,767, Apr. 5, 1982.

[51] Int. Cl.[3] ..... C10G 1/08

[52] U.S. Cl. ..... 208/10

[58] Field of Search ..... 208/8 LE, 10

[56] References Cited

U.S. PATENT DOCUMENTS

| | | | |
|---|---|---|---|
| 3,540,995 | 11/1970 | Wolk et al. | 208/10 |
| 3,607,719 | 9/1971 | Johnson et al. | 208/10 |
| 3,679,573 | 7/1972 | Johnson | 208/10 |
| 3,725,241 | 4/1973 | Chervenak | 208/10 |
| 4,148,709 | 4/1979 | Sze | 208/10 |
| 4,189,375 | 2/1980 | Kirby et al. | 208/8 LE |
| 4,322,284 | 3/1982 | Tsai et al. | 208/10 |
| 4,437,973 | 3/1984 | Huibers et al. | 208/10 |

FOREIGN PATENT DOCUMENTS

| | | | |
|---|---|---|---|
| 2737192 | 5/1978 | Fed. Rep. of Germany | 208/10 |

*Primary Examiner*—Delbert E. Gantz
*Assistant Examiner*—Lance Johnson
*Attorney, Agent, or Firm*—V. A. Mallare

[57] ABSTRACT

A process for improved catalytic hydrogenation of coal to produce increased yields of low boiling hydrocarbon liquids and gas products, in which a coal-oil slurry is fed directly with only limited preheating into an ebullated bed catalytic reaction zone to provide increased hydroconversion and improved yields of low boiling hydrocarbon liquids. In the process, a coal is slurried with a hydrogenated coal-derived liquid and heated to only a limited extent, as defined by a temperature-time severity unit index (STTU) less than about 0.1, so as to avoid depleting the hydrogen donor capacity of the solvent liquid, and the slurry is then fed directly into an ebullated bed catalytic reaction zone maintained at 650°-900° F. temperature and 1000-5000 psi hydrogen partial pressure. Supplemental heat is provided to the reaction zone as needed by heating recycled reactor liquid and recycled hydrogen streams to temperatures above the reaction zone temperature. If desired, effluent liquid from the reaction zone can be advantageously passed with hydrogen to a second ebullated bed catalytic reaction zone for further hydrogentation reaction at different severity selected to provide increased conversion of the coal and coal derived liquids and produce increased yields and/or improved selectivity of light hydrocarbon liquid products.

20 Claims, 2 Drawing Figures

VENT GAS
COAL
H2
10
11
12
14
15
15a
16
17
18
19
20
21
22
24
25
26
27
28
29
30
31
32
33
33a
33b
34
34a
35
36
37
38
39
40
41
42
42a
43
44
45
46
47
48
49
50
51
52
54

COAL CATALYTIC HYDROGENATION PROCESS USING DIRECT COAL SLURRY FEED TO REACTOR WITH CONTROLLED MIXING CONDITIONS

REFERENCE TO RELATED APPLICATION

This is a continuation-in-part of application Ser. No. 365,767, filed Apr. 5, 1982.

BACKGROUND OF THE INVENTION

This invention pertains to an improved coal hydrogenation process for producing hydrocarbon liquid and gas products, wherein a coal-oil slurry is fed directly into a catalytic reaction zone with only minimal controlled preheating to provide improved hydroconversion and produce increased yields of light hydrocarbon liquid products and gas.

Conventional processes for coal liquefaction and hydrogenation include a preheating or thermal treatment step for the coal-oil slurry feed prior to the catalytic reaction step, as generally disclosed in U.S. Pat. Nos. 3,519,555; 3,700,584; 3,791,957 and 4,111,788. Other coal hydrogenation processes use fine recycled catalysts at plug flow conditions and low solvent/coal ratios, such as U.S. Pat. Nos. 4,090,943 and 4,102,775. In these processes, the coal-oil slurry feed is preheated to near the reactor temperature before feeding it into the catalytic reaction zone.

In these conventional coal hydrogenation processes utilizing a coal-oil slurry preheating step, the hydrogen donor potential or free radical concentration in the coal-derived slurrying oil is limited as is its mobility and the hydrogen therein is usually consumed during the coal preheating step. This lack of hydrogen donor materials in the coal-oil slurry during the preheating step causes undesirable recondensation materials such as asphaltenes and other unreactive high molecular weight materials to form, thereby increasing the yield of undesired heavy hydrocarbon liquids and reducing the yield of the more desirable light hydrocarbon liquid products. However, it has been unexpectedly found that by rapid exposure of the coal feed to the dilute solids high hydrogen content liquid and catalyst in the reactor after only a controlled minimal preheating, rapid hydroconversion of the coal to produce increased yields of lower boiling hydrocarbon liquid products is substantially enhanced.

SUMMARY OF THE INVENTION

The present invention provides a coal catalytic hydrogenation process for producing increased yields of low boiling hydrocarbon liquid and gas products, wherein particulate coal is slurried with a hydrogenated coal-derived liquid and the coal slurry is fed with only a limited and controlled degree of preheating directly into a reaction zone containing coal-derived liquid and hydrogen and an ebullated bed of particulate hydrogenation catalyst. The catalytic reaction zone is maintained at 650°–900° F. temperature and 1000–5000 psi hydrogen partial pressure conditions. In any preheating of the coal slurry feed before the reaction zone, the standard temperature-time units (STTU) severity index for such preheating should be less than about 0.1, and preferably should be less than about 0.01 STTU. The coal-oil slurry preheating temperature should more preferably be below about 500° F. and such preheating preferably occurs in the coal-slurrying oil mixing step.

The standard temperature-time units (STTU) used in this invention are defined by the following mathematical expression:

$$STTU = Ate - B/T$$

where:

A = a constant, about $1.12 \times 10^{15}$ t = coal residence time in heating zone, minutes e = natural logarithm base 2.718

B = a constant, about 45045 for coal

T = heating zone temperature, °R

For example, one STTU unit is defined as 840° F. temperature for one minute exposure time, or as a lower temperature for a correspondingly increased exposure time.

This arrangement for limited preheating the coal feed according to this invention advantageously utilizes the dilute solids phase and high hydrogen content of the liquid and catalytic reaction mass in the reaction zone to quickly heat and hydrogenate the coal feed therein, and thereby avoids undesirable recondensation or retrograde reactions which occur during the usual thermal pretreatment steps for coal feed to liquefaction processes. Any preheating for the coal feed which occurs prior to its contact with hydrogen and catalyst in the reaction zone, such as in the coal-oil slurrying step or in any subsequent preheating step, is limited to a temperature-time severity index (STTU) less than about 0.1, as is determined by analysis of the particular coal-oil slurry feed material using a microautoclave reaction procedure. In the reaction zone, the coal-oil slurry feed is heated very rapidly to the hydrogenation conditions, and any additional heat needed to maintain desired temperatures therein is provided by heating recycled reaction zone liquid, and also if necessary by heating recycled hydrogen, to temperatures sufficiently above the reaction zone temperature and introducing these heated streams into the lower portion of the reaction zone.

Catalytically hydrogenated coal-derived material containing gas and liquid fractions is withdrawn from the upper portion of the reaction zone and is phase separated and distilled to provide gas and increased yields of low boiling hydrocarbon liquid products. If desired, the reaction zone can be operated at relatively low severity conditions, and the resulting liquid fraction can be fed into a second stage catalytic reaction zone maintained at more severe reaction conditions for additional hydrogenation reactions, to provide further increased yields of low-boiling hydrocarbon liquid products.

It is thus a principal advantage of the present coal hydrogenation process to eliminate or at least minimize preheating equipment, and to produce improved hydroconversion of coal derived liquids and increased yields of low-boiling hydrocarbon liquid products, such as those nominally boiling between about 400°–975° F. The invention is useful for hydrogenating and liquefying coals including bituminous, subbituminous, and lignite.

DETAILED DESCRIPTION OF INVENTION

Figure 1:
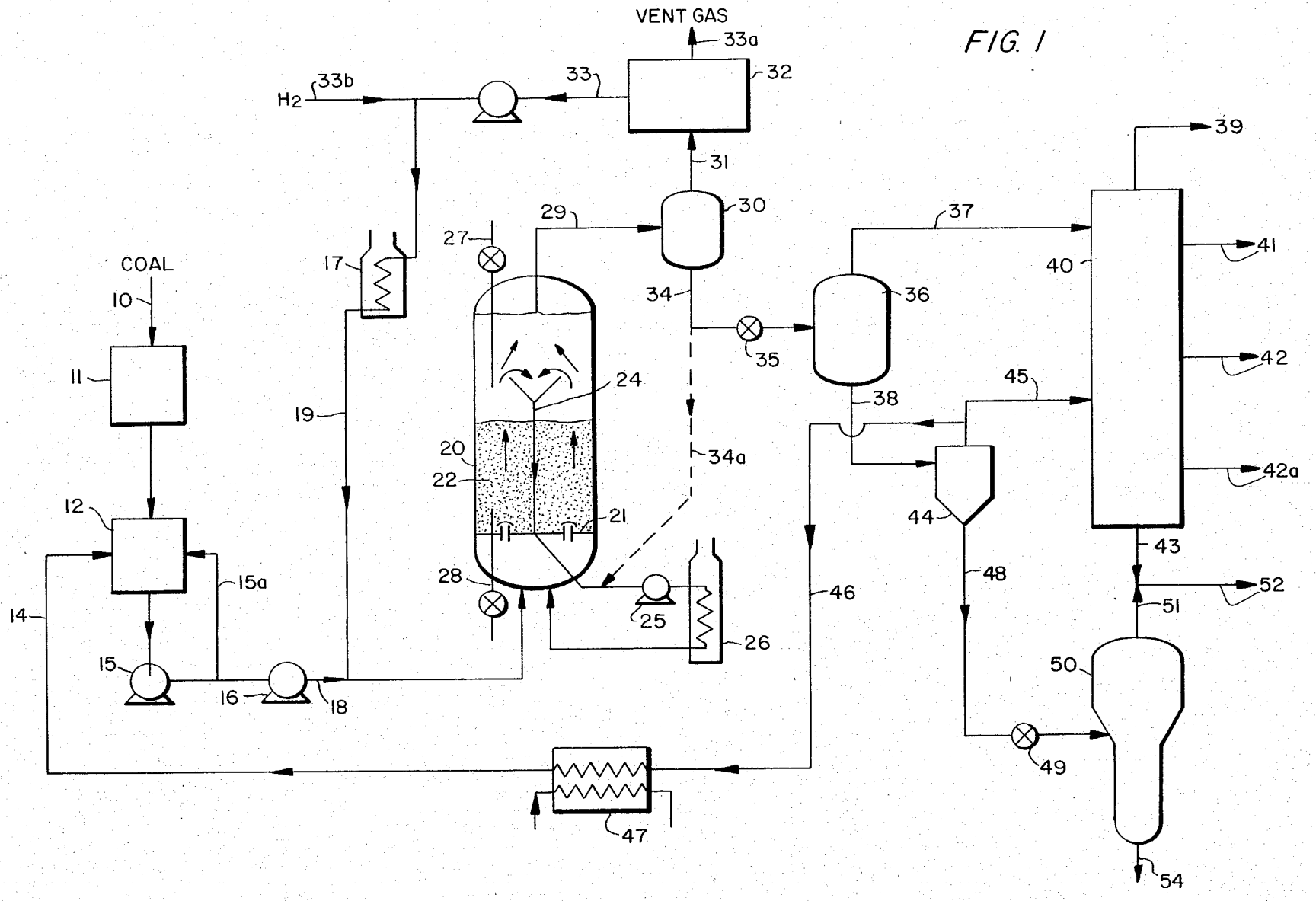
FIG. 1 is a schematic flow diagram showing one embodiment of the invention for feeding coal-oil slurry with only minimal preheating directly into a reaction zone containing an ebullated bed of hydrogenation catalyst.

In the present invention, the degree of thermal treating of the coal-oil slurry feed prior to the catalytic hydrogenation reaction is advantageously limited and controlled so as to increase the yields of low-boiling hydrocarbon liquid products. The particulate coal feed is slurried with a recycled hydrogenated oil and residuum derived from the process, and is then fed at low temperature-time severity index (STTU) exposure less than about 0.1, and preferably at temperatures below about 500° F. directly into an ebullated bed catalytic reactor. The reactor temperature is controlled at the desired 650°–900° F. temperature by heating the reactor recycle liquid to a temperature above the desired reaction zone temperature using a heat exchanger on the internal liquid recycle flow to provide any additional heat needed in the reactor.

The coal-oil slurry feed is heated only in such limited and controlled extent to avoid depleting the hydrogen donor capability of the slurrying oil and avoid thermal cracking the coal, and thereby prevent forming retrograded materials such as asphaltenes and char during such preheating of the slurry feed. The allowable degree of preheating for the coal-oil slurry depends on the chemical characteristics of the coal feed, the amount of hydrogen donor compounds contained in the slurrying oil, and also the amount of slurrying oil used relative to the coal. The maximum acceptable degree of preheating of a coal feed and slurry oil combination is determined by performing microautoclave analysis tests of the heated coal-oil slurry to determine the percent conversion achieved during standard catalytic reaction conditions.

It has been unexpectedly found that by providing direct exposure of particulate coal-oil slurry feed to the catalytic reaction zone environment without using a conventional slurry preheating step, several process advantages are realized. The coal is dissolved and reacted in a concentrated catalytic environment at a high ratio of coal-derived oils or solvent to coal and under high hydrogen content conditions favorable for conversion. Because the present process eliminates the usual coal preheating step following the coal-oil slurrying step, it avoids coal swelling effects and heat transfer problems usually encountered in fired plug flow type preheaters, and also avoids formation of undesirable thermal retrograde materials in such a usual preheating step. The present process also provides for quicker operational response to any reactor exotherm or excessive temperature which may occur by using a reactor recycle liquid trim heat exchanger, and produces higher yields of distillable oil products.

The limited amount of preheating of the coal feed which can be used is determined mainly by the availability of hydrogen donor compounds in the slurrying oil. The allowable degree of preheating for a particular coal and slurrying oil combination can be determined by analyzing the heated coal-oil slurry feed material in a microautoclave reaction unit using an established procedure to determine percent conversion of the coal-oil feed combination used. A description of the microautoclave analysis procedure which can be used is provided below.

MICROAUTOCLAVE APPARATUS TEST PROCEDURE

The microautoclave analysis procedure utilizes rapid heating and quenching for tested samples of coal and solvent while providing vigorous agitation. Two 30-cc reactors are operated simultaneously at 2000 psi hydrogen partial pressure. A heated fluidized sandbath provides the reaction heat, after which the reactors are cooled by agitating them in a waterbath. The reactors are loaded with a known amount of selected coal sample and solvent, sealed, and pressurized with hydrogen, then immersed in the heated sandbath and held there for a specific time. Tests were run to determine the appropriate heat-up and cool-down time periods (approximately 2.5 min.). After being held in the hot sandbath for a specified time, the reactors are removed and quenched.

After cooling, the reactors are depressurized, opened and the contents weighed. The contents are filtered in tetrahydrofuran (THF) solution, and the filter cake is dried and weighed. After weighing, the insolubles are mixed with toluene and filtered again. Next, the filter cake is dried and weighed. The mixing and filtering process is repeated a third time using THF as the solvent. Following the third drying and weighing, the samples are ashed and an ash balance is calculated to check the validity of the test. Coal conversion is defined as the weight of initial coal charged minus the weight of the insolubles, all divided by the weight of the initial coal charge, and the complete quantity times 100. These calculations are made on an ash-free basis. Three conversions are calculated: conversion to THF solubles, conversion to toluene solubles, and conversion to cyclohexane solubles.

The tests are conducted with 2:1 solvent to coal ratios, using the recycle solvent of interest. Sufficient temperature-time conditions are run on the coal-solvent combination of interest, the data points being chosen based on the chemical and physical properties of the coal. The range of reaction conditions used includes 650° F. temperature at 10 minutes and 60 minutes, up to 850° F. at 10 minutes and 32 minutes residence time.

KINETIC MODEL

Because a combination of temperature and time conditions are explored simultaneously, a reference model was developed and used to normalize the coal heating severity conditions to a common basis defined by a standard temperature-time unit (STTU) severity index. This model is defined by the equation $STTU = A\text{-}te - B/T$ as described above. Examples of one (1.0) STTU include 800° F. temperature for 3.15 minutes, and 840° F. for 1 minute. Results of the autoclave tests are plotted as a function of the standard temperature-time unit severity levels (STTU) used. The point at which percent coal conversion begins to rise sharply is defined as the maximum desired severity (STTU) for preheating the particular coal-slurry combination prior to entry into the ebullated bed catalytic reactor. At some higher standard severity level the coal conversion will begin to decrease; this point is a maximum severity for coal-oil slurry preheating before seeing evidence of undesired regressive or retrograde reactions occurring during preheating. Thus, all processing operations for coal-oil slurry feed in the thermal mode without hydrogen and catalyst should be kept below this critical STTU severity index level.

PROCESS DESCRIPTION

One embodiment of the present invention using a single-stage, ebullated-bed catalytic reactor is shown in FIG. 1. Bituminous coal at 10, such as Illinois No. 6, Kentucky No. 11, or a subbituminous coal such as Wyodak, is ground to a particle size smaller than about 50 mesh (U.S. Sieve Series) and dried at 11 to remove surface moisture and is passed to slurry mixing tank 12. Here the coal is blended with a process-derived slurrying oil 14 having a normal boiling range of about 550°–950° F. Such blending is in a weight ratio of oil to coal at least sufficient to provide a pumpable slurry mixture, and usually has a weight ratio range of oil to coal between about 1.1 and about 6.0. If desired, a portion 15*a* of the slurry can be recirculated by pump 15 to tank 12 to maintain a uniform slurry mixture therein. Any heating of the coal in the mixing tank 12 is at a temperature-time severity index less than about 0.1, and preferably less than about 0.01 STTU, and usually is at a temperature range of 350°–500° F.

The coal-oil blend from slurry mixing tank 12 is pressurized by pump 16, which pumps the blend through conduit 18 along with recycle hydrogen 19 directly into ebullated bed reactor 20 containing hydrogenated coal-derived liquid, hydrogen and a bed 22 of particulate commercial hydrogenation catalyst. The coal-oil blend is passed with hydrogen through flow distributor 21 and upwardly through the catalyst bed 22 at sufficient velocity to expand the bed. The catalyst bed 22, which may suitably comprise particles such as 0.030–0.130 inch diameter extrudates of nickel molybdate or cobalt molybdate on alumina or similar support material, is expanded by at least about 10% and not over about 100% of its settled height by the upflowing fluids, and is kept in constant random motion during reaction by the upward velocity of the coal-oil blend and hydrogen gas.

The coal-oil blend is passed upwardly through the reactor 20 in contact with the catalyst at a space velocity of about 7.5 to 90 pounds of coal/hour/cubic foot of reactor volume, and preferably from about 30 to 60 pounds of coal/hour/cubic foot. Reaction conditions are preferably maintained within the range of 750°–860° F. temperature and 1200–4500 psi hydrogen partial pressure. Reactor liquid is recycled through downcomer conduit 24 and recycle pump 25 to heater 26, where the liquid is heated to a temperature required to maintain the desired reactor temperature, such as 10°–100° F. above the reactor temperature. The reheated liquid is then passed upwardly through distributor 21 to maintain sufficient temperature and upward liquid velocity to expand the catalyst bed and maintain the catalyst in random motion in the liquid to assure intimate contact and complete reactions. The weight ratio of heated recycled reactor liquid to coal slurry feed is within a range of about 1.0 and 10.0.

If necessary or desired, recycled hydrogen can be heated to a temperature exceeding that of the catalytic reaction zone, and usually to about 10°–100° F. above. Also, if desired all or a portion 19*a* of recycle hydrogen stream 19 can be mixed with recycled reactor liquid in conduit 24 upstream of heater 26. Fresh catalyst is added to the reactor at connection 27 as needed to maintain the desired catalytic activity therein, and used catalyst removed at 28. In the reactor 20, the coal-oil slurry feed is heated rapidly to the reaction temperature and simultaneous hydrogenation and catalytic conversion of the coal and slurrying oil occurs with consumption of some hydrogen. Also, because the coal-derived slurrying oil contains hydrogen donor compounds and has significant solvent properties affecting the coal, the hydrogenation reactions may be achieved at a somewhat lower reaction temperature than would otherwise be necessary.

From the reactor 20, effluent stream 29 is usually cooled and passed to hot phase separator 30. The resulting gas portion stream 31 is passed to hydrogen purification step 32, from which medium purity hydrogen is recovered as needed at 33 and undesired gases including $H_2$, $CO_2$, $H_2S$ and water are vented at 33*a*. Stream 33 is heated at 17, as needed, and recycled at 19 to the reactor along with make-up hydrogen at 33*b* as needed.

From separator 30, liquid stream 34 is also withdrawn, pressure-reduced at 35, and passed to phase separator 36, which operates at near atmospheric pressure and 500°–650° F. temperature. If desired, a major portion 34*a* of liquid stream 34 can be recycled to reactor 20 as the recycled reactor liquid instead of liquid stream 24. From separator 36, a light hydrocarbon overhead stream is removed at 37 containing naphtha and light distillate fractions and is passed to fractionation step 40.

Liquid stream 38, which typically has a normal boiling range above about 550° F. and contains some asphaltenes, unconverted coal and ash, is passed to liquid-solids separation system 44, which can comprise multiple hydroclones or a solvent precipitation system. Overflow stream 45 containing a reduced concentration of particulate solids is also passed to fractionation step 40, wherein the liquid is fractionated into product streams comprising gas, naphtha, light and middle range distillates, and heavy residuum boiling range oils containing unconverted coal and ash. Specifically, product streams from the fractionator 40 are withdrawn as product gas at 39, $C_4$-400° F. naphtha fraction at 41, liquid distillate liquid at 42 and heavy distillate liquid at 42*a*, and a heavy fuel oil at 43. A portion 46 of overhead liquid from liquid-solids separation step 44 is recycled to the slurry tank 12 and then to reactor 20 to slurry the coal and help control the percentage of unconverted coal and ash solids in the reactor within a desired range, typically about 10 to 25 W %. If desired, cooling of recycled stream 46 can be accomplished at heat exchanger 47.

From liquid-solids separation step 44, underflow stream 48 is passed to vacuum distillation at 50. Vacuum overhead stream 51 can be combined with fractionation bottoms stream 43 to provide liquid product stream 52. The heavy vacuum bottoms material nominally boiling above about 975° F. at 54 can be used for coking to recover oil, or as a feed material for hydrogen production.

If desired to achieve increased percentage conversion of the coal feed in the present invention, two stages of catalytic reaction can be advantageously used, with the severity conditions for each reaction stage being selected to achieve the desired overall hydrogenation and product yield results. The first stage reactor can be operated at low severity conditions of about 650°–750° F. temperature, 1000–4000 psi hydrogen partial pressure and about 30–90 lb coal/hr/ft$^3$ space velocity. The second stage reactor is then operated at moderate severity conditions of 750°–840° F. temperature, at essentially the same hydrogen partial pressure, and at 20–60 lb/hr/ft$^3$ space velocity. Alternatively, the first stage reactor can be operated at moderate severity conditions of 750°-825° F. temperature and 1500-3500 psig hydrogen partial pressure, and the second stage reactor operated at high severity of 825°-875° F. temperature and the same pressure.

It is also contemplated within the scope of the present invention and depending upon the particular coal-derived liquid product selectivity desired, that the first stage reactor can be operated at more severe conditions of 750°-850° F. temperature and 2000-4000 psig hydrogen partial pressure to crack and partially hydrogenate the coal, and the second stage reaction is then operated at milder conditions of 650°-750° F. temperature to upgrade the hydrogenated material to remove oxygen, nitrogen and sulfur.

Figure 2:
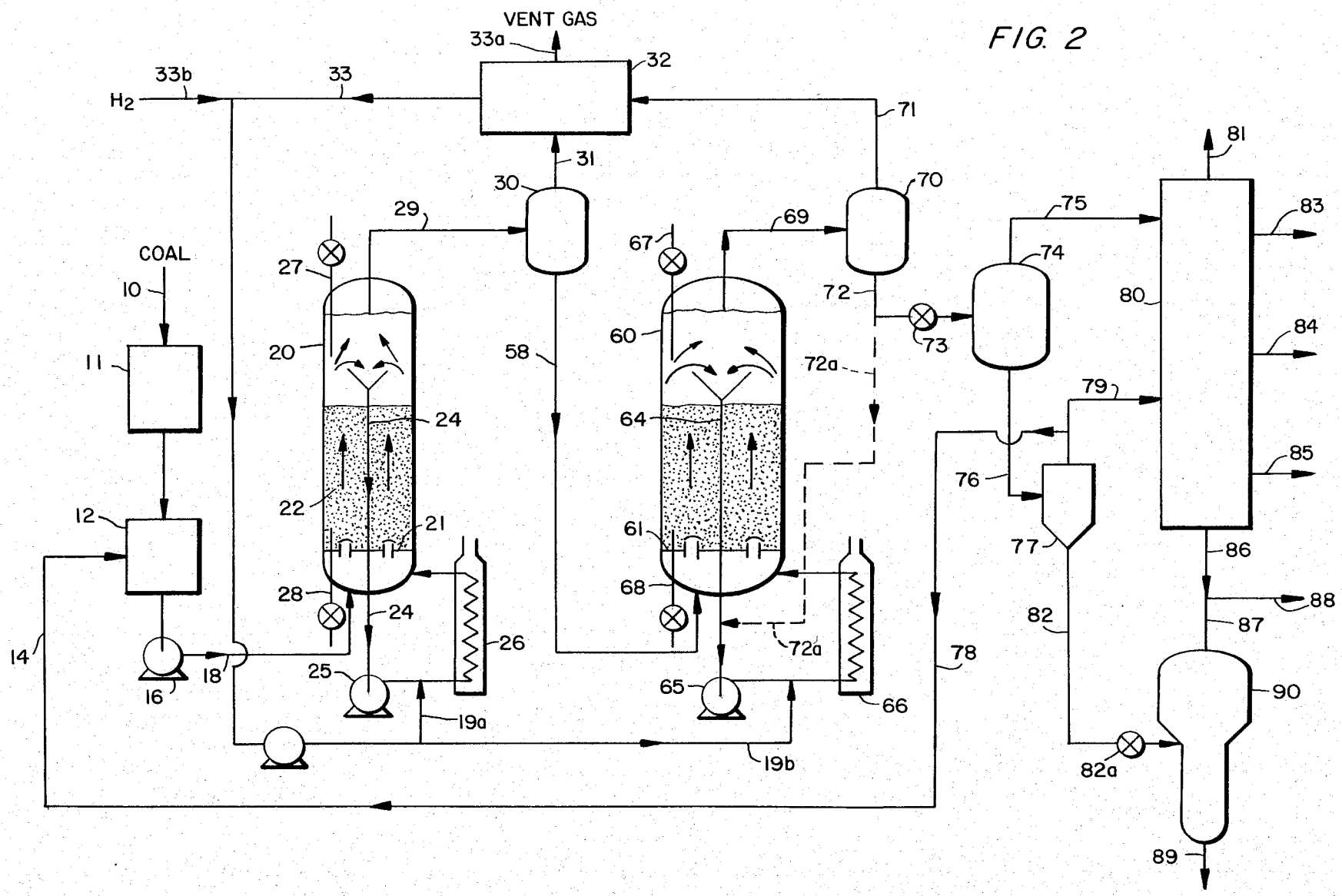
FIG. 2 shows an alternative embodiment of the invention, utilizing two catalytic reaction zones connected in a series flow arrangement.

With reference now to FIG. 2, an alternative process embodiment is shown which is similar to FIG. 1 but utilizes two stages of catalytic reaction for the coal-oil slurry feed. Similarly as described for FIG. 1 above, coal feed from 10 and oil slurry 14 are blended in the mixing zone 12, pressurized by pump 16, and the slurry passed with only minimal preheating directly to the reactor 20. Recycled hydrogen is provided at 19*a* into the reactor liquid recycle stream 24 upstream of heater 26. In reactor 20, the coal-oil slurry undergoes rapid heating and hydrogenation reactions while passing upwardly through the ebullated bed 22 of catalyst particles. The coal-oil slurry passes upwardly through reactor 20 in contact with the catalyst at a space velocity of 30-90 coal/hr/ft$^3$. Reaction conditions are preferably maintained within ranges of 650°-750° F. temperature and 1500-4500 psig hydrogen partial pressure. Relatively simultaneous conversion of the coal and heavy coal-derived oil occurs with the consumption of hydrogen to produce lower boiling hydrocarbon liquids and gas. Reactor liquid is recycled downward through conduit 24, recycle pump 25, and heater 26 where it is heated along with the hydrogen from 19*a* to a temperature as needed to maintain the desired reactor temperature.

From the reactor 20, a hydrogenated effluent material is removed via conduit 29 and is passed to hot phase separator 30. Alternatively, the effluent material at 29 can be passed directly to second stage catalytic reactor 60. The separated gas stream 31 is passed to hydrogen recovery system 32, from which undesired gas is vented at 33*a* and recovered hydrogen stream 33 is recycled to the reactors 20 and 60 along with fresh make-up hydrogen at 33*b* as needed.

From phase separator 30, the liquid portion is withdrawn as stream 58 and passed to second stage ebullated bed reactor 60. The hydrocarbon liquid slurry material passes upwardly through flow distributor 61 and reactor 60 in contact with the catalyst 62 at a space velocity of about 20 to 60 pounds of coal/hour/cubic foot of reactor volume, and preferably about 25 to 50 pounds of coal/hour/cubic foot. Reaction conditions are preferably maintained within the range of 750°-840° F. temperature and 1500-3500 psig hydrogen partial pressure. Reactor liquid is recycled through downcomer conduit 64 and recycle pump 65 to heater 66, where it is heated along with hydrogen stream 19*b* to a temperature as needed to provide the desired reaction temperature, then passed upwardly through distributor 61 to maintain sufficient upward liquid velocity to expand the catalyst bed and maintain the catalyst in random motion in the liquid to assure intimate contact and complete reactions. Fresh catalyst is added to the reactor at connection 67 as needed and used catalyst removed at 68.

In the reactor 60, simultaneous hydrogenation and conversion of the coal and slurrying oil occurs with consumption of some hydrogen. Also, because the coal-derived slurrying oil contains hydrogen donor compounds and has significant solvent properties affecting the coal, the hydrogenation reactions may be achieved at a somewhat lower reaction temperature than would otherwise be necessary. If the temperature desired in reactor 60 is lower than that for first reactor 20, the reactor liquid recycled downward through conduit 64 and recycle pump 65 and mixed with recycled hydrogen stream 19*b*, can be cooled at a heat exchanger 66*a* (replacing heater 66) as necessary to maintain the desired temperature in reactor 60.

From the reactor 60, effluent stream 69 is passed to hot phase separator 70. The resulting gas portion stream 71 is passed to hydrogen purification step 32. From separator 70, liquid stream 72 is withdrawn, pressure-reduced at 73, and passed to phase separator 74. If desired, a liquid portion 72*a* can be recycled to reactor 60 as the recycled reactor liquid. Overhead stream 75 is passed to fractionation system 80, wherein the liquid is fractionated into product streams comprising gas, naphtha, light and middle range distillates, and heavy residuum boiling range oils containing unconverted coal and ash.

From phase separation step 74, liquid stream 76 is passed to liquid-solids separation system 77, which can comprise multiple hydroclones or a solvent precipitation system. A portion 78 of the overflow liquid stream containing reduced solids concentration is returned to coal slurrying zone 12, and the remainder 79 is passed to fractionation system 80. From solids separation step 77 underflow stream 82 containing increased solids concentration is passed to vacuum distillation at 90, from which a bottoms material stream is removed at 89.

The overhead liquid passed via conduit 75 to fractionation system 80 is separated therein into gas stream 81, $C_4$-400° F. naphtha fraction stream 83, and light and heavy distillate oil products at 84 and 85, respectively. Bottoms material 86 is withdrawn from the fractionator 80 and can be combined with vacuum distillation overhead stream 87 to provide product stream 88. Vacuum bottoms material at 89 can be used for coking to recover oil, or as a feed material for hydrogen production.

This invention will be further described by reference to the following examples, which should not be construed as restricting its scope.

EXAMPLE 1

Illinois No. 6 bituminous coal in particulate form was slurried with a coal-derived liquid, heated to only about 400° F. temperature for about 30 minutes, i.e. to less than about 0.001 STTU, and the coal slurry was introduced into a reaction zone containing hydrogenated coal-derived liquid, hydrogen gas, and an ebullated bed of a coal hydrogenation catalyst. Reaction zone conditions were maintained at 850° F. temperature and 2000 psig hydrogen partial pressure.

A comparison of typical results achieved by this direct coal slurry feed hydrogenation process, compared to conventional coal hydrogenation processes using preheating of the coal-oil slurry feed to near the reactor temperature and using essentially the same reaction conditions, is provided in Table 1 below.

TABLE 1

COAL HYDROGENATION PROCESS RESULTS WITH AND WITHOUT SLURRY FEED PREHEATING STEP

| | With Preheating (Run 218-3) | Without Preheating (Run 177-65) |
|---|---|---|
| Coal Slurry Mix Tank Temperature, °F. | 350 | 400 |
| Coal Slurrying Residence Time, min. | 30 | 30 |
| Coal-Oil Slurry, Feed Temperature, to Reactor, °F. | 700 | 380 |
| Preheating Temperature-Time Units (STTU) | 0.46 | <0.01 |
| Reaction Conditions: | | |
| Temperature, °F. | 850 | 850 |
| $H_2$ Partial Pressure, psig | 2000 | 2000 |
| Space Velocity, lb/hr/ft$^3$ | 31 | 31 |
| Catalyst Age, lb coal/lb catalyst | 350 | 710 |
| Product Yields, W % Dry Coal Feed | | |
| $C_1$–$C_3$ Gas | 10.0 | 9.7 |
| $C_4$-400° F. Liquid | 16.9 | 19.8 |
| 400–975° F. Liquid | 29.3 | 34.0 |
| 975° F.+ Liquid | 18.9 | 12.2 |
| $C_4$-975° F. Liquid | 46.2 | 53.8 |
| Percent Coal Conversion, W % | 94.1 | 95.9 |

From the above results, it is seen that when the coal-oil slurry is fed directly into the reactor at less than about 0.1 STTU without a conventional preheating step, significantly increased yields of $C_4$-400° F. and $C_4$-975° F. hydrocarbon liquid fractions are produced along with decreased yields of heavy 975° F.+ liquid, which occurs even at increased average catalyst age.

Although this invention has been described broadly and with reference to certain embodiments thereof, it will be understood that modifications and variations to the process can be made and some steps used without others all within the spirit and scope of the invention, which is defined by the following claims.

We claim:

1. A process for catalytic hydrogenation of coal to produce increased yields of low boiling hydrocarbon liquid products and gas, the process comprising:

(a) mixing particulate coal with a hydrogenated coal-derived hydrocarbon liquid to provide a flowable coal-oil slurry material having a standard temperature-time units (STTU) severity index exposure less than about 0.1 wherein said STTU index is defined by the following relation:

$$STTU = Ate^{-B/T}$$

where

A = about $1.12 \times 10^{15}$ t = the coal residence time in minutes

B = about 45045

T = the temperature in °R;

(b) feeding said coal-oil slurry directly into a catalytic reaction zone, along with a heated coal-derived recycle liquid and recycle hydrogen, so as to avoid formation of thermal retrograded material during any heating of the coal occurring before said reaction zone;

(c) passing said coal-oil slurry and said hydrogen upwardly through said reaction zone containing coal-derived liquid and hydrogen and an ebullated bed of particulate catalyst maintained at 650°–900° F. temperature and 1000–5000 psi hydrogen partial pressure and 7.5–90 lb/hr ft$^3$ space velocity for rapidly heating and reacting the coal therein and providing catalytic hydrogenation reactions to produce coal-derived hydrogenated material therein;

(d) withdrawing a portion of said coal-derived liquid from said reaction zone at a level above said ebullated bed of particulate catalyst adjusting the withdrawn liquid temperature as required to control said reaction zone temperature, and recycling the coal-derived liquid to the lower portion of the reaction zone;

(e) withdrawing from the upper part of said reaction zone a coal-derived hydrogenated material containing gas and liquid fraction, and phase separating said material into gaseous and liquid fractions;

(f) passing said liquid fraction to a liquid-solids separation step, from which an overhead liquid stream containing a reduced solids concentration is recycled to provide said hydrogenated coal-derived liquid for providing said coal-oil slurry; and (g) recovering hydrocarbon gas and increased yields of low boiling hydrocarbon liquid products from the process.

2. The process of claim 1, wherein the weight ratio of slurrying oil to coal is between about 1.1 to 6.0.

3. The process of claim 1, wherein said coal-derived liquid withdrawn from said reaction zone is heated to a temperature about 10°–100° F. above the reaction zone temperature.

4. The process of claim 1, wherein the weight ratio of heated reactor recycle liquid to coal slurry feed is within a range from about 1.0 to 10.0.

5. The process of claim 1, wherein said hydrogen is separately heated to a temperature exceeding the temperature of said catalytic reaction zone.

6. The process of claim 1, wherein said hydrogen is heated and added to said recycle coal-derived liquid before passing the resulting mixture to the catalytic reaction zone.

7. The process of claim 1, wherein said coal-oil slurry feed is heated to a standard temperature-time unit severity index less than about 0.01 before feeding the coal-oil slurry into said reaction zone.

8. The process of claim 1, wherein said coal-oil slurry feed is heated in said coal slurrying step (a).

9. The process of claim 1, wherein said reaction zone is maintained within a temperature range of 750°–870° F. and 1500–4500 psi hydrogen partial pressure.

10. The process of claim 1, wherein said coal feed is bituminous type coal.

11. The process of claim 1, wherein said coal-oil slurry feed is heated to temperature below about 500° F.

12. The process of claim 1, wherein said phase separated liquid fraction is passed with hydrogen to a second stage catalytic reaction zone at space velocity of 15–90 lb/hr/ft$^3$ reactor zone volume for further hydrogenation reactions.

13. A process for catalytic hydrogenation of coal to produce increased yields of low boiling hydrocarbon liquid products and gas, the process comprising:

(a) mixing particulate coal with a hydrogenated coal-derived hydrocarbon liquid to provide a flowable coal-oil slurry material having a temperature below about 500° F. and having a standard temperature-time severity unit (STTU) factor less than about 0.01 wherein said STTU index is defined by the following relation:

$$STTU = Ate^{-B/T}$$

where
A = about $1.12 = 10^{15}$
t = the coal residence time in minutes
B = about 45045
T = the temperature in °R;

(b) feeding said heating coal-oil slurry directly into a catalytic reaction zone along with separately heated coal-derived hydrocarbon liquid and hydrogen, so as to avoid formation of thermal retrograded material;

(c) passing said heated coal-oil slurry and hydrogen uniformly upwardly through said reaction zone containing coal-derived liquid and hydrogen and an ebullated bed of particulate catalyst maintained at 750°-870° F. temperature and 1500-4000 psi hydrogen partial pressure for providing catalytic hydrogenation reactions therein to produce a coal-derived hydrogenated material;

(d) withdrawing a portion of said hydrogenated coal-derived liquid from said reaction zone at a level above said ebullated bed of particulate catalyst, heating the withdrawn liquid to a temperature about 10°-100° F. above the reaction zone temperature, and returning the heated liquid to a lower portion of the reaction zone;

(e) withdrawing from the upper part of said reaction zone a coal-derived hydrogenated material containing gas and liquid fractions, and phase separating said material into gaseous and liquid product fractions;

(f) passing said liquid product fraction to a solids-separation step, from which an overhead liquid material containing a reduced solids concentration is recycled to provide said hydrogenated coal-derived hydrocarbon liquid for providing said coal-oil slurry; and (g) recovering hydrocarbon gas and increased yields of low boiling hydrocarbon liquid products from the process.

14. A process for catalytic hydrogenation of coal to produce increased yields of low boiling hydrocarbon liquid products and gas, the process comprising:

(a) mixing particulate coal with a hydrogenated coal-derived hydrocarbon liquid to provide a flowable coal-oil slurry material having a standard temperature-time units (STTU) severity index exposure less than about 0.1 wherein said STTU index is defined by the following relation:

$$STTU = Ate^{-B/T}$$

where
A = about $1.12 \times 10^{15}$
t = the coal residence time in minutes
B = about 45045
T = the temperature in °R;

(b) feeding said coal-oil slurry directly into a first catalytic reaction zone, along with a heated coal-derived recycle liquid and recycle hydrogen, so as to avoid formation of thermal retrograded material during any heating of the coal occurring before said reaction zone;

(c) passing said coal-oil slurry material and hydrogen upwardly through said first reaction zone containing coal-derived liquid and hydrogen and an ebullated bed of particulate catalyst maintained at 650°-750° F. temperature and 1000-5000 psi hydrogen partial pressure for rapidly heating and reacting the coal therein and providing catalytic hydrogenation reactions to produce a coal-derived hydrogenated material;

(d) withdrawing a portion of said coal-derived liquid from said first reaction zone at a level above said ebullated bed of particulate catalyst, adjusting the temperature of the withdrawn liquid as required to control said reaction zone temperature, and recycling the coal-derived liquid to the lower part of said first reaction zone;

(e) withdrawing from the upper part of said first reaction zone a coal-derived hydrogenated material containing gas and liquid fractions, and phase separating said material into gaseous and liquid fractions;

(f) passing said separated liquid fraction to a second catalytic reaction zone along with heated coal-derived recycle liquid and recycled hydrogen, and passing said liquid fraction and coal-derived recycle liquid and recycle hydrogen upwardly through said second catalytic reaction zone containing an ebullated bed of particulate catalyst maintained at 700°-800° F. temperature and 1000-5000 psig hydrogen partial pressure and further reacting the liquid fraction material therein to produce a further hydrogenated material;

(g) withdrawing a portion of the hydrogenated coal-derived liquid from said second reaction zone at a level above said ebullated bed of particulate catalyst, adjusting the temperature of the withdrawn liquid as required to control said second reaction zone temperature, and recycling the coal derived liquid to the lower portion of said second reaction zone;

(h) withdrawing from the upper part of said second catalytic reaction zone said further hydrogenated material containing gas and liquid fractions, and phase separating said material into gas and liquid fractions;

(i) passing said separated liquid fraction to a liquid-solids separation step, from which an overhead liquid stream containing a reduced solids concentration is recycled to provide said hydrogenated coal-derived liquid for providing said coal-oil slurry; and (j) recovering hydrocarbon gas and increased yields of low boiling hydrocarbon liquid products from the process.

15. The process of claim 14, wherein said coal-derived liquid withdrawn from said first reaction zone is heated to a temperature about 10°-100° F. above the reaction zone temperature.

16. The process of claim 14, wherein the ratio of heated reactor recycle liquid from said first reaction zone to coal slurry feed is within a range of about 1.0 to 10.0.

17. The process of claim 14, wherein said hydrogen is separately heated to a temperature exceeding the temperature of said first catalytic reaction zone.

18. The process of claim 14, wherein said hydrogen is heated and added to the recycle liquid before passing the mixture to said first catalytic reaction zone.

19. The process of claim 14, wherein a portion of said phase separated liquid is recycled to said second catalytic reaction zone.

20. A process for catalytic hydrogenation of coal to produce increased yields of low boiling hydrocarbon liquid products and gas, the process comprising:

(a) mixing particulate coal with a hydrogenated coal-derived hydrocarbon liquid to provide a flowable coal-oil slurry material having a standard temperature-time units (STTU) exposure less than about 0.1 wherein said STTU index is defined by the following relation:

$$STTU = Ate^{-B/T}$$

where
A = about $1.12 \times 10^{15}$
t = the coal residence time in minutes
B = about 45045
T = the temperature in °R;

(b) feeding said coal-oil slurry directly into a first catalytic reaction zone, along with a heated coal-derived recycle liquid and recycled hydrogen, so as to avoid formation of thermal retrograded material during any heating of said coal occurring before said reaction zone;

(c) passing said coal-oil slurry and said hydrogen upwardly through said first reaction zone containing coal-derived liquid and hydrogen and an ebullated bed of particulate catalyst maintained at 750°–850° F. temperature and 1000–5000 psi hydrogen partial pressure for rapidly heating and reacting the coal therein and providing catalytic hydrogenation reactions to produce a coal-derived hydrogenated material;

(d) withdrawing a portion of said coal-derived liquid from said first reaction zone at a level above said ebullated bed of particulate catalyst, adjusting the withdrawn liquid temperature as required to control said reaction zone temperature as desired, and recycling the coal-derived liquid to the lower portion of the reaction zone;

(e) withdrawing from said first reaction zone upper part a coal-derived hydrogenated material containing gas and liquid fractions, and phase separating said material into gaseous and liquid fractions;

(f) passing said liquid fraction to a second catalytic reaction zone along with heated coal-derived recycled liquid and recycled hydrogen, and passing said liquid fraction and hydrogen upwardly through said second catalytic reaction zone containing an ebullated bed of particulate catalyst maintained at 650°–750° F. temperature and 1000–5000 psi hydrogen partial pressure and further reacting the liquid material therein to produce a further hydrogenation material;

(g) withdrawing a portion of the hydrogenated coal-derived liquid from said second reaction zone at a level above said ebullated bed of particulate catalyst, adjusting the temperature of the withdrawn liquid as required to control said second reaction zone temperature, and recycling the coal derived liquid to the lower portion of said second reaction zone;

(h) withdrawing from the upper part of said second catalytic reaction zone said further hydrogenated material containing gas and liquid fractions and phase separating said material into gas and liquid fractions;

(i) passing said separated liquid fraction to a liquid-solids separation step, from which an overhead liquid stream containing a reduced solids concentration is recycled to provide said hydrogenated coal-derived liquid for providing said coal-oil slurry; and (j) recovering hydrocarbon gas and an increased yield of low boiling hydrocarbon liquid products from the process.

* * * * *